United States Patent [19]

Caspe

[11] Patent Number: 4,766,706

[45] Date of Patent: Aug. 30, 1988

[54] EARTHQUAKE PROTECTION SYSTEM FOR STRUCTURES

[76] Inventor: Marc S. Caspe, 1640 Oakwood Dr., San Mateo, Calif. 94403

[21] Appl. No.: 839,232

[22] Filed: Mar. 12, 1986

[51] Int. Cl.[4] ..... E04H 9/02; E04B 1/36

[52] U.S. Cl. ..... 52/1; 52/167

[58] Field of Search ..... 52/1, 167

[56] References Cited

U.S. PATENT DOCUMENTS

| | | | |
|---|---|---|---|
| 3,638,377 | 2/1972 | Caspe | 52/294 |
| 4,098,034 | 7/1978 | Howell | 52/1 |
| 4,587,773 | 5/1986 | Valencia | 52/1 |
| 4,635,892 | 1/1987 | Baker | 52/167 |

FOREIGN PATENT DOCUMENTS

| | | | |
|---|---|---|---|
| 2254974 | 7/1975 | France | 52/167 |
| 579379 | 10/1977 | U.S.S.R. | 52/167 |

*Primary Examiner*—John E. Murtagh

*Attorney, Agent, or Firm*—Townsend and Townsend

[57] ABSTRACT

A system for protecting a building against the forces generated by an earthquake. The horizontal movement of the building superstructure relative to the foundation is adjustable to adapt its damping system to prevailing wind conditions. The superstructure moves horizontally along a system of movable plates provided at the interface between the superstructure and the foundation. Wind velocity reading devices placed on the exterior of the building provide signals to a transducer which adjusts a controller to vary a threshold force applied to the superstructure to determine the force required to initiate movement of the superstructure relative to the foundation. A sandwiched system of three levels of low friction plates beneath each column, interconnected by three levels of diaphragm linkages, restricts the movement of the columns and walls solely to a combination of orthogonal, rectilinear motion.

39 Claims, 3 Drawing Sheets

EARTHQUAKE PROTECTION SYSTEM FOR STRUCTURES

This specification incorporates by reference the disclosures in the inventor's earlier granted U.S. Pat. No. 3,638,377, issued Feb. 1, 1972.

BACKGROUND OF THE INVENTION

The present invention relates to a system for protecting a building against damage due to earthquake forces.

Earthquakes present a major public safety hazard to building occupants and persons on the streets below. Earthquakes also create a major economic liability for building owners and communities that depend on the continuity of building usage. Buildings must be protected against the effects of structurally damaging forces generated by the random ground movements of earthquakes. The building superstructure must be capable of responding to displacing forces due to earthquakes, yet remain stable during high wind conditions. In the inventor's previously granted patent, the contents of which are incorporated by reference, the maximum horizontal force tolerated by that earthquake protection system had a predetermined magnitude which was preestablished during design and which could not be changed once the structure had been constructed. By providing an adjustable maximum horizontal force, higher safety factors can be attained during low wind conditions that are most common.

The random motions generated by earthquakes sometimes result in forces which tend to force a twisting or torsional rotation of the superstructure about a vertical axis. Such torsional rotation causes undesirable additional relative displacement at the exterior columns and walls of the superstructure. The vertical component of earthquake forces also cause uplifting at some parts of the superstructure. These uplift forces introduce damaging impact forces once the uplift force has subsided and the lifted portions of the superstructure drop suddenly. These torsional and uplifting motions could also erode the safety factors that are utilized in calculating the design tolerances for the system.

Sequential earthquake jolts in a particular direction may result in a buildup of relative displacement of the building. Therefore, it would be desirable for an earthquake protection system to urge the building to move back towards its original position whenever possible after relative displacement has occurred. Such jolts can also cause instability in the columns of a building when the building's weight is held eccentric to the vertical axis of the columns. It is therefore desirable to maintain concentric loading in the columns.

SUMMARY OF THE INVENTION

The present invention provides a "force barrier" system for controlling the earthquake response of a building. The system adapts to the surrounding wind characteristics by continuously adjusting the "threshold force," or the maximum horizontal force withstood by the building before horizontal displacement along controlled movable surfaces is permitted. The columns supporting the building superstructure above the foundation are restricted to combinations of orthogonal and horizontal movement to prevent significant torsional movements of the columns. The column support plates are also interlocked to prevent significant uplifting movements of the columns. The building's combination of orthogonal horizontal motion is biased back towards an original position by a passive hydraulic biasing system. Thus, the present invention provides for operational flexibility of the earthquake protection system in varying wind conditions, passively prevents undesirable torsional and uplifting movements, and urges the building towards its normal position to limit any cumulative relative displacement between the building and its foundation.

Accordingly, in one form, the apparatus of the present invention comprises means for transferring the superstructure weight to the foundation which permits substantial relative horizontal movements between the superstructure and the foundation under the influence of minor horizontal forces. Control means, which are independent of the weight transferring means, transmit horizontal forces between the superstructure and the foundation. The control means have a bilinear force-deflection characteristic which substantially prevents horizontal movements between the superstructure and the foundation when subjected to a horizontal force up to a predetermined magnitude, while permitting substantial horizontal movements between the superstructure and the foundation once the horizontal force exceeds the predetermined magnitude. The force exerted by the control means during the relative movement of the superstructure is relatively constant and at least about equal to the maximum force exerted by the control means during nonmovement of the superstructure.

Broadly speaking, the present invention accomplishes these goals by separating the building superstructure from the foundation at a linkage between the columns of the superstructure, above the fixed foundation itself. For the purpose of this application, "foundation" is defined as the fixed supporting part of a structure below the support plates. "Superstructure" includes that part of a building above the support plates, including the framework of columns, floors and walls.

The superstructure is separated from the foundation by a series of movable support plates between the base of the superstructure and the top of the foundation, that permit horizontal motion of the superstructure at a threshold force of predetermined magnitude. Wind sensors provided along the exterior of the building superstructure generate signals which correspond to the prevailing wind velocities. These signals are routed to a controller that in turn adjusts the predetermined force at which relative displacement can occur. This active wind adjustment system remains passive during an earthquake. One configuration of the invention includes regulating friction actuators provided to restrain each of the movable plates. A transverse holding force applied to the plates increases or decreases in accordance with the signals to vary the threshold force of the superstructure's earthquake protection system according to the wind conditions. This threshold force is the force at which the superstructure begins to have relative displacement with respect to the foundation.

The plates are confined to move in any combination of orthogonal horizontal directions. A sandwich of three plates is provided, where the top plate is fixed to the column, the bottom plate is fixed to the foundation, and the middle plate is sandwiched between the top and bottom plates. The middle plate moves in a first linear direction with respect to the top plate and a second linear direction perpendicular to the first direction with respect to the bottom plate. In this manner, the system of horizontal sliding plates passively provides a type of universal joint between the superstructure and the foundation. The plates are also confined to prevent movement in the vertical direction by an interlocking of the plates so that uplifting motion is prevented.

The force necessary to cause movement of the plates is primarily controlled in the horizontal direction by dampers which provide resistance to the movement of the plates. The damper system consists of either frictional slide plates, hysteretic steel members or hydraulic piston members which determine the magnitude of force required to initiate movement of a plate, and the overall distance a plate can travel. The damper system serves also to dissipate a portion of the earthquake's energy. The damper system is connected only to the middle plate of each column, with the members oriented in either orthogonal direction around each column.

In addition to the damper system, a series of hydraulic centering or biasing pistons urge the movable top and middle plates back towards their original positions by relying on reversals in direction of the ground velocities generated by the earthquake to hydraulically urge the superstructure towards its original positions by introducing high acceleration forces when the ground is pulling away from the superstructure and low decelerating forces when the superstructure is attempting to "catch up."

More specifically, the invention contemplates the construction of a new building or retrofitting of an existing building with the present earthquake protection system by installing a system of stacked, horizontally movable plates beneath each column of the superstructure at the foundation. A low friction lubricant surface, such as Teflon® or roller bearings, facilitates relative sliding movement between the plates. The low friction surface on the top plate is bonded concentrically with the column center line so that, when relative displacement takes place, no significant eccentric loads are introduced into the columns. The relative horizontal distances between adjacent columns and between all top, middle and bottom plates are maintained by diaphragms of rigid members which interlock the columns and each level of plates. The threshold force required to initiate relative motion between the plates is principally determined by a variable transverse force applied to the stacks of plates in conjunction with the selected damper system or combination of damper devices.

Wind velocity sensing devices are provided on the exterior portion of the building. A transducer converts the wind velocity readings to generate signals which adjust the damper system force at which relative motion is initiated, such as by increasing the force applied to the particular damper device in accordance with the prevailing wind conditions.

A universal joint restricts the plates to rectilinear movement. This joint consists of the assembly of horizontal plates beneath each column which includes a top plate which has a carriage protruding from its undersurface to fit into a linear track embedded in the middle plate. This first carriage and track pair determine the direction of movement between the top and middle plate. The planar undersurfaces of the top plate and upper surfaces of the middle plate are in frictional contact and are coated with a dry lubricant such as Teflon® or roller bearings. A second carriage and track pair is provided between the bottom plate and the middle plate. This second carriage and track pair defines a linear direction of movement which is perpendicular to the direction of movement defined by the carriage and track pair between the top and middle plate. The planar undersurface of the middle plate and upper surface of the bottom plate are also in frictional contact with lubricant coatings or roller bearings.

The tracks provided in the plates are provided with longitudinally extending flanged edges to prevent any relative vertical displacement between plates. This prevents the column from lifting up and away from the foundation. Such uplift forces could cause harmful impact loads when the force subsides and the column suddenly impacts the foundation. Thus, the assembly of plates significantly prevents both torsional and uplifting forces.

The middle movable plates are biased towards their original position by a completely passive system of hydraulic biasing pistons arranged in either orthogonal direction. A cylindrical chamber filled with the hydraulic fluid is connected to each middle plate and fitted with a piston to reciprocate in the direction in which the plate moves and a neoprene cradle to act as a spring in either direction. The head of the piston is a plate provided with control valves to allow fluid to pass from one side of the piston head to the other or through piping that links the opposite chambers. Under normal conditions, the piston head is located at a zero position within the cylindrical chamber. The chamber is designated as having a "right" end through which the piston arm enters, and a "left" end which is closed and opposite the right end. The zero position is located somewhere between the left and right ends. The one or more control valves (in the piston head or in the piping) are set to open at predetermined pressures corresponding to the force on the piston arm at which relative displacement is initiated by earthquake movements and to maintain that force by opening further whenever the relative velocity increases.

Two liquid flow circuits are provided to circulate the fluid within the left and right chambers. An opening is provided through the chamber wall at or near the zero point, so that no flow goes through the circuits until the opening is crossed over by the piston head when it is moved away from the normal position. The normal position of the piston head defines a left chamber and a right chamber corresponding to the left and right ends of the chamber. The left flow circuit circulates fluid from the zero point opening to the left chamber to bias the piston head away from the left chamber towards the zero point, while a right flow circuit analogously biases the piston head away from the right chamber towards the zero point.

Thus, the present invention prevents damage to the building by permitting controlled and adjustable relative movement between the building superstructure and the foundation in varying wind conditions. Relative displacement is only permitted in the horizontal direction and no significant torsional rotation is permitted. Cumulative displacement is significantly prevented by a hydraulic centering system that urges the superstructure back towards center. Eccentric loads on the columns are avoided and all columns are rigidly interconnected by diaphragms. With the exception of the wind adjustment system, the entire system is completely passive, so that power failures which commonly accompany earthquakes have no effect on the operation of the building's protection system. Thus, damage to the building and its occupants are minimized.

DESCRIPTION OF THE PREFERRED EMBODIMENT

Figure 1A:
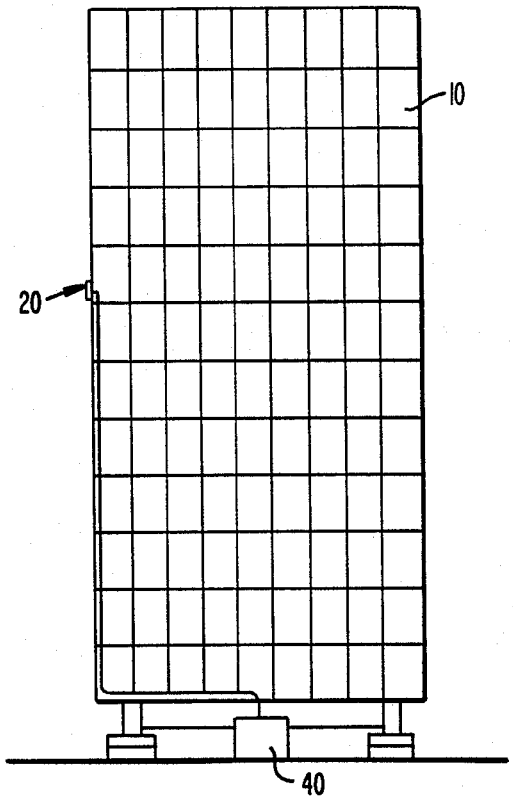
FIG. 1A is a schematic illustration of a building equipped with apparatus for adjusting the earthquake response of the building according to wind conditions.
Figure 1B:
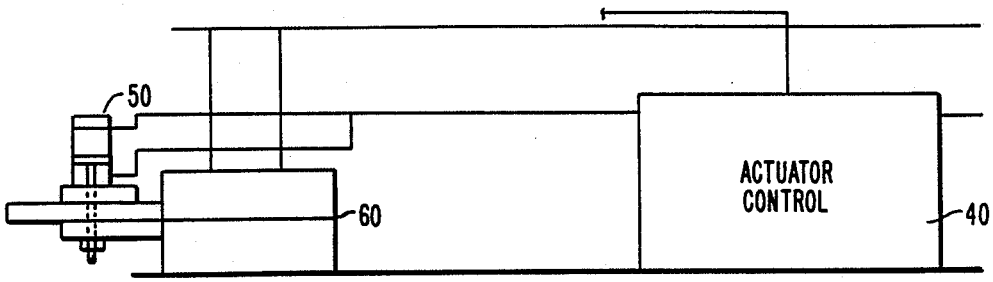
FIG. 1B is a detail from FIG. 1A which shows a schematic diagram of the adjusting mechanism.

FIGS. 1A and 1B schematically illustrate the apparatus for adjusting the earthquake protection system to compensate for varying wind conditions. In the preferred embodiment, the building's superstructure and foundation are interconnected by a system of horizontally disposed movable friction interface which permits relative horizontal motion between the foundation and the superstructure when the magnitude of the horizontal forces generated by an earthquake exceed a threshold transverse load applied to the interface. By varying the transverse load, the horizontal reaction of the building can be controlled to adjust for changing wind conditions. In high wind conditions, the threshold force would be increased to prevent the building from moving along the interface.

A typical building 10 as shown in FIG. 1A has at least one wind sensor 20, in each orthogonal direction, mounted on an external surface where it is likely to encounter high wind velocities. The wind sensor 20 is a transducer which reads wind velocities and translates the velocities into signals, typically electrical signals, which are transmitted to an actuator control 40. The actuator controller 40 is linked to transverse loading means, typically a hydraulic piston 50 which accordingly increases or decreases the transverse load applied to frictional interfaces 60. The controller is designed to increase the transverse load applied by the piston 50 when it receives signals indicating a condition of high wind velocities, so that movement along the friction interfaces 60 is not initiated by gusts of strong wind. Conversely, the actuator control 40 reduces the transverse loading on the interfaces when the wind conditions are more typical. In this manner, the response of the structure to wind conditions can be continuously monitored and controlled.

Figure 2:
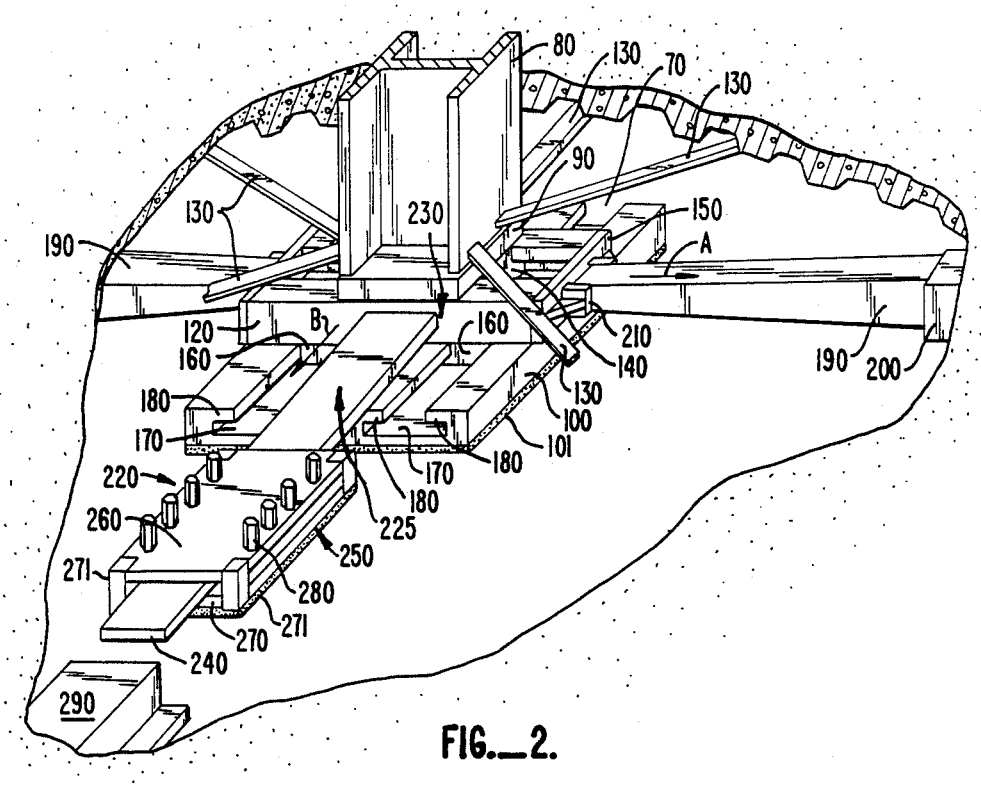
FIG. 2 is a perspective view of a column equipped with the apparatus of the earthquake protection system.

FIG. 2 illustrates the plate assembly 70 at the base of a typical column 80 at the foundation of the building. The superstructure of the building is separated from the foundation by the plate assembly 70 which consists of a stacked series of plates—top plate 90 which is fixed to the bottom of the column 80, bottom plate 100 which is essentially fixed to the foundation or a floor above the foundation 110 and a middle plate 120 sandwiched between the top and bottom plates. To separate the superstructure from the foundation, the combination of the plates are movable in any horizontal direction to accommodate the random movements generated by earthquakes. To assure that the columns of the superstructure do not experience an eccentric load that could cause column instability under the weight of the building, the underside of the top plate 90 is coated with a low-friction surface that is concentrically bonded to the column center line, thereby permitting it to slide on the larger top surface of the middle plate 120 without introducing eccentricity.

To assure that the building's superstructure moves as a single unit, adjacent columns in the building's array of columns are linked by interlocking diaphragm struts 130 which rigidly maintain the distances between adjacent columns 80. To assure that the superstructure does not rotate significantly in the plane of the relative movement, the adjacent middle plates under the array of columns are also linked by interlocking diaphragm struts 130 which rigidly maintain the distances between adjacent middle plates 120.

Relative movement between the superstructure and the foundation is preferably confined to motions in the horizontal direction only. Due to the vertical and rotative forces generated by earthquakes, columns at portions of the superstructure may be subjected to torsional rotation about some vertical axis. Such a twisting or torsional rotation is undesirable because it creates exaggerated displacements at the corner columns of the superstructure. The vertical component of movement due to earthquake forces is also harmful since it may cause an uplift at some columns, thereby separating the column from the superstructure. Damage may result when the uplifting force subsides and the column falls suddenly on the foundation thereby generating substantial impact forces. Reactive forces at other columns of the building are also introduced to oppose the uplift forces. The torsional forces are transmitted by the plate assembly through an interlocking in the horizontal direction of the tracks and carriages of the top, middle and bottom plates. These uplifting forces are transmitted by the plate assembly through an interlocking in the vertical direction of the top, middle and bottom plates.

To resist any torsional rotation, the plate assembly is confined to horizontal orthogonal movement. The top plate 90 is limited to linear motion with respect to the middle plate 120 in a first direction designated by the arrow A. A carriage having an inverted T-shaped cross-section 140 protrudes from the underside of top plate 90 and slidingly engages a complementary-shaped track 150 embedded in the middle plate 120. The middle plate 120 is restricted to horizontal movement with respect to bottom plate 100 in the direction designated B. One or more carriages 160 protrude from the undersurface of the middle plate 120 to slidingly engage complementary-shaped tracks 170 provided on the upper surface of the bottom plate 100. Direction A is perpendicular to direction B. By the cooperation of the three plates along the track and carriage pairs, a universal range of motion in the horizontal direction is permitted. The bottom plate 100 is mounted to the foundation atop neoprene shear spring 101. These resilient shear springs afford the mounting of the movable plate assembly some flexibility, thereby controlling the initial stiffness of the biasing pistons during an earthquake.

Vertical movement of the track and carriage pairs is prevented by the flanged edges 180 which extend longitudinally along the tracks 170 and 150. These flanged edges 180 form upper stop members against the carriages which ride along their respective tracks. All contacting surfaces between the plates must be coated with a lubricant, preferably Teflon® or roller bearings so that frictional losses are reduced.

Figure 3:
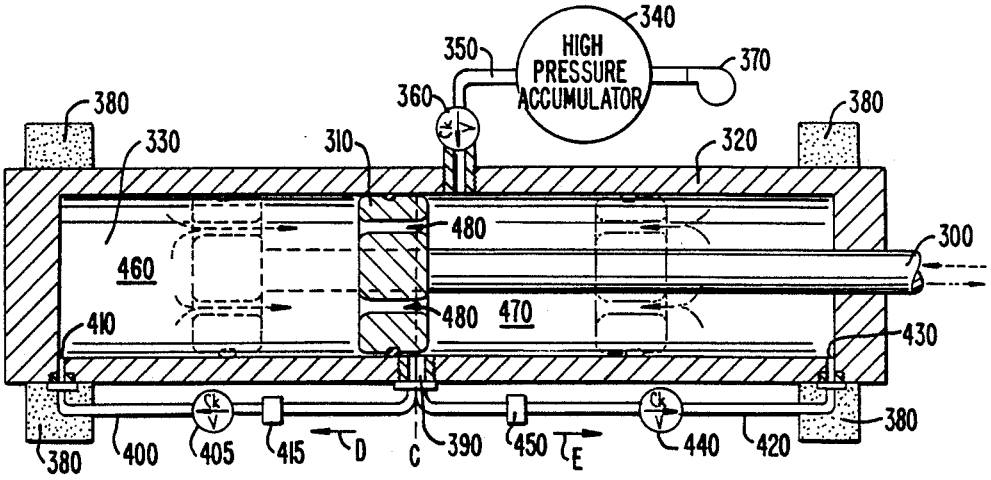
FIG. 3 is a cross-sectional diagram illustrating a biasing piston.

In addition to the transverse loading means 280 used for adjusting the friction interfaces between the plates of the plate assembly 70 for varying wind conditions, an additional damper system is provided to further control horizontal motion of the plates. Two different types of damper devices are illustrated in FIGS. 2 and 3. In FIG. 2 a hysteretic damper consists of a member 190 extending from a pinned connection 210 to the middle movable plate and terminating in a fixed mount 200 connecting it to the foundation. The member 190 has a cross-section of varying width to provide controlled inelastic strain in the member as the middle plate moves in the direction perpendicular to the axis of the member. The varying width provides a constant stress gradient so that inelastic strains can be distributed over a greater length of the member 190. An alternate embodiment of the hysteretic damper is shown on FIG. 4 wherein a simple beam 500 is connected to the middle plate 120 at two points, resulting in a constant length middle span 510 that distributes inelastic strains over that entire middle span without changing the member width. Adjustment of the damper span length can provide varying force levels for varying wind conditions.

Figure 5:
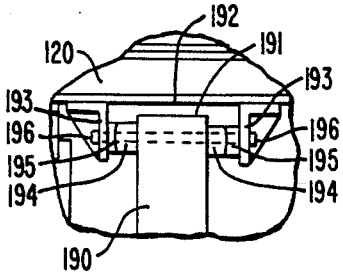
FIG. 5 is a detailed top view of the linkage between a hysteretic beam and a middle plate.

In the detailed view of FIG. 5, the linkage between the hysteretic member 190 and middle plate 120 is shown. The terminal end 191 is mounted in a joint which permits movement along the longitudinal axis of member 190 in the direction indicated by the arrow A (FIG. 2). The end 191 is also spaced apart from middle plate wall 192 to permit a degree of movement towards middle plate 120. The hysteretic beam is typically constructed of stainless steel, and is pinned in place between two L-shaped flanges 193 fixed to middle plate 120 and contacting member 190 at two Teflon® coated pads 194. The Teflon® coated pads have rounded ends nearest the flanges which are compressed against concave stainless steel sockets 195 which permit a degree of rotative movement. The flanges, Teflon® coated pads and sockets are in a linear arrangement transverse to the longitudinal axis of member 190, with a compressive load applied by precompression rods 196.

Figure 4:
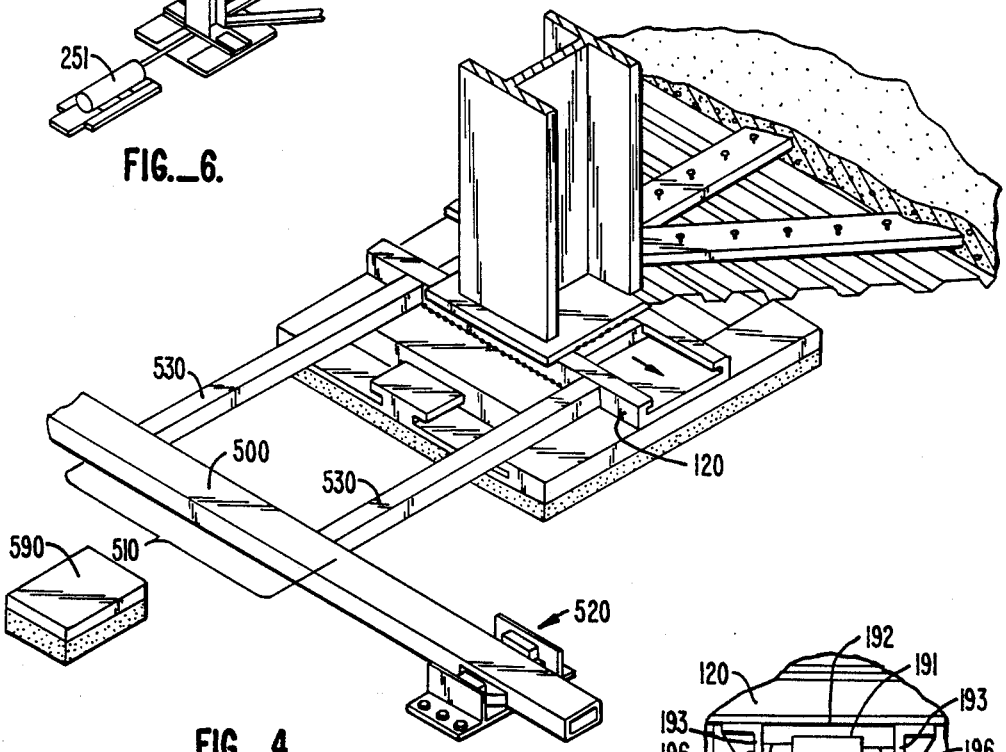
FIG. 4 is a perspective view of an alternative embodiment of a hysteretic damper device.

A linkage similar to that shown in FIG. 5 may be used on the embodiment of the hysteretic damper shown in FIG. 4. The pin support assembly 520 may be used to vary the span length of the beam 500 to respond to varying wind conditions.

A second type of damper is the friction damper 220. An arm 225 extends from the fixed mount 230 at the movable plate to a free end 240. The arm 225 is longitudinally movable in the direction of movement of the middle plate to which it is attached. The free end 240 passes through a prestress assembly 250 which applies a compression force to the arm 225 and determines the resistance force applied to the arm 225. The prestress assembly 250 is basically an upper plate 260 and a lower plate 270 which are spaced apart a predetermined distance through which the cantilever arm is free to move. Jacks or nuts 280 may be used to tighten the plates 260 and 270 together to increase the frictional force applied to the arm 225, which can have an adjustable pressure for wind conditions. The top plate 260 is laterally restrained by lugs 271 that protrude upwards from bottom plate 270 as guides. The bottom plate 270 is mounted to the foundation on a resilient shear spring 274 to control the initial stiffness of the friction damper. The overall distance of travel of arm 225 is limited by a stop member 290 which is mounted to the foundation a distance from the end 240 of arm 225. Preferably, the stop member 290 is a spring constructed of a resilient material such as neoprene.

Figure 6:
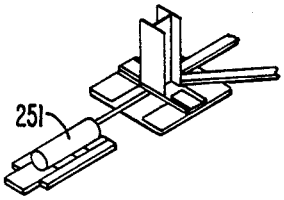
FIG. 6 is a perspective view of the exterior of a piston damper.

As an alternative to the pre-stress assembly, an hydraulic piston damper 251 and chamber (FIG. 6) might also be substituted as the damper. A piston damper can also have an adjustment for wind forces by adjusting the control valve settings of the piston to adjust the hydraulic response of the damper device.

The design of the plate assembly 70 is such that the dimensions of the plates are sufficient to accommodate relative displacement well within a predetermined safety factor. Although earthquake movements are generally random, there is some chance that the movement might produce cumulative affects which would result in total displacements which are greater than anticipated. To prevent such accumulations of displacement, it is desirable to bias the movable plates back towards their original positions. One or more of the biasing pistons, such as the one illustrated in FIGS. 3 and 4, may be linked to each middle movable plate to produce such a biasing effect. Each installed biasing piston is arranged to oppose the direction of the movement of the movable plate to which it is linked. It would be known to one skilled in the art how to connect the piston arm 300 to the middle movable plates, therefore such a linkage is not illustrated. The piston arm 300 terminates in a piston head 310 which moves reciprocably through a cylindrical piston chamber 320. The chamber 320 is filled with a hydraulic fluid 330. As a matter of convention, the end through which the piston arm 300 enters the chamber is designated the "right" end while the opposite closed end is designated the "left" end.

The fluid pressure in the chamber is maintained by an external accumulator tank schematically illustrated and identified by the numeral 340. The accumulator tank 340 is maintained at high pressure and is connected to the chamber 320 along a line 350 which has a one-way valve 360 directing flow into the chamber if the pressure falls below a predetermined minimum pressure level. A pump 370 activates to provide the motive force to force the fluid into the accumulator tank and keep it charged. Failure of the pump or its power system has no effect on the biasing effect of the system.

The chamber 320 is mounted to the foundation atop neoprene shear springs 380. These resilient shear springs afford the mounting of the chamber on the foundation some flexibility, thereby controlling the initial stiffness of the biasing pistons during an earthquake.

In a nonearthquake situation, the piston head remains at a zero position designated by the letter C. Two openings 39 are provided in the chamber wall at or near the zero position. The piston head 310 is the valve which crosses over the opening 390 before flow can begin in either flow circuit. It is in the nonearthquake position when it is located at the zero position in the chamber. A left flow line 400 connects the opening 390 at the zero position with the left end of the left chamber at an opening 410. The line 400 is provided with a check valve 405 which opens only in the direction indicated by the arrow D of fluid flowing from the zero position towards the left end. A control valve 415 is also provided on the line between the zero position and the check valve. The right flow line 420 is similarly provided to connect the zero position 390 and the right end of the chamber at an opening 430. A check valve 440 which opens only in the direction of flow indicated by the arrow E from the zero position towards the right end of the chamber directs the fluid flow, and a control valve 450 between the zero position and the check valve. The direction of flow at any instant of time is dependent on both the relative position of the piston with respect to line C and the relative velocity between the piston which is attached to the superstructure, through the middle plate, and the chamber which is attached to the foundation.

The longitudinal thickness of the piston head 310 divides the chamber 320 into a left chamber 460 and a right chamber 470 on either side of the zero position 390. A plurality of control valves 480 in the piston head open and close at predetermined pressures to regulate fluid flow through the piston head from one chamber to the other. Multiple control valves may be arranged to open at increasing pressures to limit the maximum velocity of the fluid through the piston, or a single control valve could be used to modulate the flow.

Figure 7:
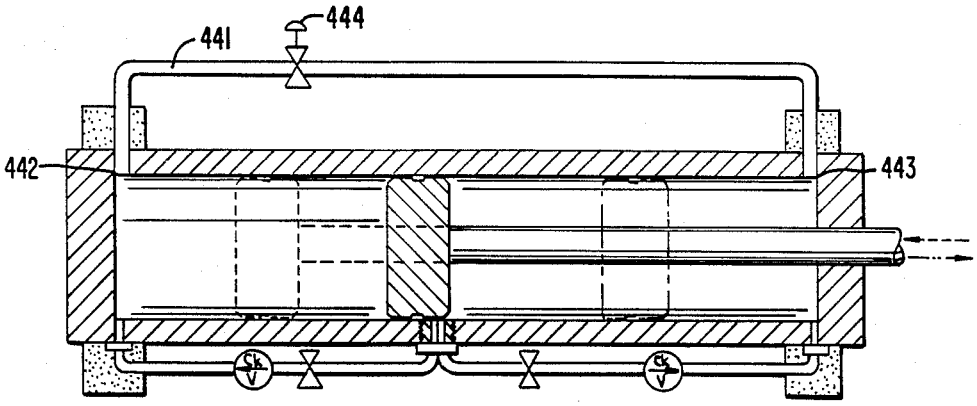
FIG. 7 is a cross-sectional diagram illustrating another embodiment of a biasing piston.

In an alternative embodiment (FIG. 7), the control valves in the piston head can be eliminated with a flow line 441 connecting the left end 442 and the right end 443 as a substitute to accommodate flow from one chamber to the other. Control valve 444 disposed along the line 441 is set to open at a predetermined pressure.

Four fluid flow conditions in the biasing pistons are possible. The first fluid flow condition is defined as the situation in which the piston head 310 moves to the left of the zero position 390 towards the left end of the chamber. Under this condition, the resistance against movement of the plate is afforded by the hydraulic fluid 330, and fluid flow is solely determined by the control valves 480 in the piston head. Control valves 480 open according to their design settings to allow fluid to pass from the left chamber to the right chamber. No fluid flows through either fluid flow circuit. No fluid flows through line 420 since both its inlet 390 and outlet 430 are on the same side of the piston head. No fluid flows through line 400 since the check valve 405 does not open in the direction of flow from the outlet 410 to inlet 390.

The second flow condition exists when the piston head is within the left chamber and moving towards the zero position. This flow condition is shown in broken lines in left chamber 460. This situation occurs once the foundation velocity reverses itself with respect to the superstructure to pull the piston arm towards the right end of the chamber. Under this flow condition, the movement of the piston head causes a pressure buildup in the right chamber which forces fluid through the left fluid flow circuit from at or near the zero position 390 towards the left end opening 410 after passing through the left pressure reducing valve 415 and check valve 405. This additional flow of fluid through the left fluid flow circuit reduces the pressure on the piston, thereby reducing the decelerating force and urging the superstructure to slide back towards its zero position more rapidly.

The third flow condition is defined as the scenario in which the piston head 310 is moving away from the zero position towards the right end of the chamber. Analogous to the first flow condition, the resistance afforded by the fluid is defined solely by the settings of control valves 480 in the piston head. No fluid flows through either fluid flow circuit.

As the relative velocity between the foundation and the superstructure reverse direction, the fourth flow condition is presented. The piston head 310 moves from a position within the right chamber towards the zero position as shown in phantom lines in chamber 470. Fluid is forced through the right fluid flow line 420, passing through control valve 450, opening the right check valve 440, and urging the piston head back towards the zero position as described above in the second flow condition.

The apparatus of the earthquake protection system can easily be installed in an existing building having a conventional foundation. The system is extremely reliable due to its simplicity in design, construction and operation. The entire assemblage can be housed between an existing floor system and a new floor system with a floor-to-floor dimension of approximately 10 to 14 inches. These floor systems can provide both high levels of fireproofing protection and access for inspection. In the case of a newly constructed building, the system of the present invention is relatively inexpensive to install, when compared to the presently-used systems, and could be less expensive because of cost savings in the superstructure.

The foregoing is a complete description of the invention, but is not intended to limit the scope of the invention, except as stated in the appended claims. Variations of the devices disclosed herein may be used in combination to provide a customized system of earthquake protection for a structure. For instance, the hydraulic piston dampers might also serve as biasing pistons for a column, as well as adjusting the threshold force of the column to wind conditions. While the above provides a full and complete disclosure of the preferred embodiment of the invention, various modifications, alternate constructions and equivalents may be employed without departing from the true spirit and scope of the invention.

What is claimed is:

1. Apparatus for resisting torsional rotation of a building superstructure about a vertical axis relative to a foundation of the building, wherein the building superstructure includes an array of columns and walls supporting the building above the foundation, said apparatus provided between the base of each column and the foundation, comprising:

a top plate, a middle plate and a bottom plate in a vertically stacked, three-level arrangement, wherein said top plate is fixedly mounted to the base end of a column, and said bottom plate is fixedly mounted to an upper surface that is connected to the foundation which is centered directly below said top plate at a normal position, with said middle plate sandwiched between said top plate and said bottom plate, contacting surfaces of said plates being provided with a low-friction lubricant, said top, middle and bottom plates further comprising means for guiding horizontal movement of said plates relative to one another, said guiding means constraining said top plate to horizontal linear movement in a first direction with respect to said middle plate and said guiding means further constraining said middle plate to horizontal linear movement with respect to said bottom plate in a second direction that is perpendicular to said first direction, said guiding means comprising mating track and carriage pairs provided in adjacent plate surfaces for sliding engagement, wherein the track and carriage pair between said top plate and said middle plate are oriented for movement in said first direction and wherein the track and carriage pair between said middle plate and the bottom plate are oriented for movement in said second direction.

2. The apparatus of claim 1, wherein said low-friction lubricant comprises a coating of tetrafluoroethylene on stainless steel.

3. The apparatus of claim 1, wherein said low-friction lubricant comprises an array of ball bearings.

4. The apparatus of claim 1, wherein each said carriage protrudes from the bottom surface of the above-most plate of two adjacent plates and each said track is a trough provided in the upper surface of the lowermost plate of the two adjacent plates.

5. The apparatus of claim 1, wherein said top plate further comprises a low-friction lubricant surface that is bonded concentrically to the column centerline so that when relative displacement between the foundation and the superstructure takes place, no significant eccentric loads are introduced into the columns.

6. The apparatus of claim 1, wherein said bottom plate further comprises a neoprene pad fixedly mounted under said bottom plate.

7. The apparatus of claim 1, wherein each said track further comprises a pair of flanges which extend from either side of said track along the length of said track, said flanges providing a vertical limit barrier to retain said carriage from moving vertically upwardly.

8. Apparatus for reducing the displacement of a building having a superstructure relative to its foundation during an earthquake, the superstructure being supported above a foundation by columns and isolated from the foundation by assemblies of horizontally movable plates fixed between bases of the columns and the foundation permitting relative horizontal movement between the superstructure and the foundation during an earthquake, said apparatus being disposed between each of said movable plate assemblies and said foundation and comprising:

a piston arm linked at one end to said horizontally movable plate and having a piston head at the other end;

a chamber, mounted to said foundation and having a left end opposite said piston arm and a right end through which said piston arm enters said chamber, said chamber being cylindrically shaped, having a fixed volume and filled with a fluid, through which said piston head is reciprocally and longitudinally movable, wherein said piston head is normally situated at a zero position spaced apart from either end of said chamber, said piston head thus defining a left chamber and a right chamber;

a first control valve opening at a predetermined pressure, said first control valve disposed to connect fluid flow between said left chamber and said right chamber;

means for biasing said piston head towards said zero position, comprising a left flow circuit and a right flow circuit for circulating fluid within said chamber, wherein said left flow circuit comprises a left liquid line circulating fluid from said zero position to the left end of said chamber through a first check valve, wherein said first check valve remains closed during a first flow condition in which said piston head is displaced by movement of said movable plates from said zero position towards said left end of said chamber, causing said pressure differential valves to open at their predetermined settings to permit said piston head to travel into said left chamber, and wherein said left line further comprises a second control valve between said first check valve and said zero position, such that during a second flow condition in which said piston head travels from said left chamber towards said zero position, fluid is forced from said zero position through said second control valve and through said first check valve to reduce the forces acting on and thereby urging said piston head towards said zero position, and said right flow circuit comprises a right line circulating fluid from said zero position to the right end of said chamber through a second check valve, wherein said second check valve remains closed during a third flow condition in which said piston head is displaced by movement of said movable plates from said zero position towards said right end of said chamber, causing said control valves to open at their predetermined settings to permit said piston head to travel into said right chamber, and wherein said right line further comprises a third control valve between said second check valve and said zero position, such that during a fourth flow condition in which said piston head travels from said right chamber towards said zero position, fluid is forced from said zero position through said third control valve and through said right check valve to reduce the forces acting on and thereby urging said piston head towards said zero position.

9. The apparatus of claim 8, further comprising an accumulator tank maintained at high pressure, connected to said chamber to maintain the fluid volume within said chamber.

10. The apparatus of claim 9, further comprising a fourth control valve along a line between said accumulator tank and said chamber, said fourth control valve opening automatically should there be a pressure drop detected in said chamber.

11. The apparatus of claim 9, further comprising a pump for generating a motive force to force liquid from a reservoir into said accumulator tank.

12. The apparatus of claim 8, wherein said chamber is mounted atop and affixed to a resilient spring cradle fixed between said chamber and the foundation.

13. Apparatus for controlling the earthquake response of a building, the building having a foundation and a superstructure, the superstructure including an array of columns, horizontally disposed floors and vertical walls, comprising:

means for separating loads supported by the superstructure from the foundation, said separating being means disposed between the foundation and the lowermost portion of the superstructure, said separating means further comprising transducer means for determining the magnitude of wind velocities applied to the exterior of the building and for generating corresponding signals;

means for controlling the amount of horizontal force necessary to cause relative movement between the foundation and the superstructure of the building in response to said signals;

means for resisting torsional and uplifting forces on said columns, said resisting means comprising:

a plate assembly comprising a top plate, a middle plate and a bottom plate in a vertically stacked arrangement beneath the lowermost ends of each column adjacent to the foundation, wherein said top plate is fixedly mounted to the lowermost end of the column and said bottom plate is fixed to an upper surface of the foundation directly beneath the column, and said middle plate is sandwiched between said top plate and said bottom plate, said plate assembly further comprising means for guiding relative movement between plates, whereby said guiding means constrains said top plate to horizontal linear movement in a first direction with respect to said middle plate and said guide means constrains said middle plate to horizontal linear movement in a second direction that is perpendicular to said first direction with respect to said bottom plate;

a plurality of centering pistons connecting said middle plates respectively to the superstructure, wherein each said centering piston is mounted to its respective middle plate to be movable in the direction of horizontal movement of that plate, each centering piston comprising a piston arm linking the plate and a piston head;

a cylindrical chamber, said chamber filled with a fluid through which said piston head is longitudinally movable towards opposite ends of said chamber, said chamber having a right end through which said piston arm enters, and a left end opposite said right end, wherein said piston head under normal conditions is located at a zero position disposed along the length of said chamber between the ends of said chamber, wherein said piston head defines a left chamber and a right chamber, further wherein said piston head further comprises at least one of a first set of control valves opening at a predetermined pressure to permit fluid flow between said left and right chambers; and means for biasing said centering piston hydraulically towards said zero position when said centering piston is displaced by earthquake forces.

14. The apparatus of claim 13, further comprising first and second diaphragms, wherein said first diaphragm comprises struts interconnecting said columns, and said second diaphragm comprises struts interconnecting said middle plates, whereby said first and second diaphragms rigidly maintain the distances between said columns and said middle plates respectively, as well as resisting rotation of said columns and said middle plates in the plane of relative movement by their geometry.

15. The apparatus of claim 13, wherein said separating means comprises horizontally movable plates having lubricant coated surfaces at the interfaces between said plates.

16. The apparatus of claim 13, wherein said top plate further comprises a low-friction surface that is bonded concentrically with the column center line such that when relative displacement occurs, no eccentric loads are introduced into the columns.

17. The apparatus of claim 13, wherein said separating means comprises an array of roller bearings confined at the interfaces between said plates.

18. The apparatus of claim 13, wherein said transducer means comprises at least one wind velocity measurement device mounted to a surface of said building exposed to wind forces.

19. The apparatus of claim 13, wherein said controlling means of said separating means comprises means for transversely loading the horizontally disposed friction interfaces between said top, middle and bottom plates whereby relative horizontal motions are permitted between the foundation and the superstructure of the building when the magnitude of horizontal force generated during an earthquake exceeds the transverse load applied to said friction interfaces multiplied by the coefficient of friction for the interfaces.

20. The apparatus of claim 19, wherein said transverse loading means further comprises hydraulic jacks through which variable compression loads are applied to said friction interfaces.

21. The apparatus of claim 13, wherein said controlling means comprises damper pistons connected to said middle plate, said damper pistons reciprocating in the same direction that said middle plate is movable, said damper piston further comprising control valves that open at variable pressures in response to said signals from said transducers.

22. The apparatus of claim 13, wherein said controlling means comprises horizontally disposed hysteretic beams connected to said middle plates, said hysteretic beam disposed to bend as said middle plate moves, said hysteretic beam further comprising adjustable pin supports, wherein said pin supports adjustably vary the span length of said hysteretic beam available for bending.

23. The apparatus of claim 13, wherein said bottom plate further comprises a neoprene pad fixedly mounted under said bottom plate.

24. The apparatus of claim 13, wherein said isolating means comprises roller bearing sets disposed between said top plate and said middle plate, and between said middle plate and said bottom plate.

25. The apparatus of claim 13, wherein said guiding means comprises mating tracks and carriages provided on adjacent plate surfaces, wherein each said carriage extends from a first plate surface of a first plate and slidingly engages a track which is complementary in shape to said carriage and disposed in an adjacent second plate surface of a second plate adjacent to said first plate.

26. The apparatus of claim 25, further comprising uplift stops, wherein said uplift stops prevent the columns from lifting vertically away from the foundation.

27. The apparatus of claim 26, wherein said uplift stops comprising horizontally extending flanges provided on said tracks to slidingly engage an inverted T-shaped, horizontally disposed protrusion of said carriages.

28. The apparatus of claim 13, wherein said plate assembly further comprises dampers to regulate horizontal movement of said plate assembly.

29. The apparatus of claim 28, wherein said dampers comprise hysteretic beams having two ends, said hysteretic beams connected at one end to said middle plate and connected at the opposite end to the foundation, said hysteretic beams mounted to extend radially from said middle plate, shaped to bend elastically until the application of a predetermined threshold force and bending inelastically once the predetermined threshold force has been exceeded.

30. The apparatus of claim 28, wherein said dampers comprise an arm radiating from a fixed mount on said middle plate, with a free end passing through a prestress assembly fixedly mounted to said foundation such that said prestress assembly exerts a predetermined frictional force on said arm to resist longitudinal movement of said arm and middle plate.

31. The apparatus of claim 30, wherein said prestress assembly comprises an upper plate and a lower plate mounted to said foundation in a vertically stacked arrangement, spaced apart a predetermined distance wherein said cantilever arm extends through and between said upper plate and said lower plate, wherein said predetermined distance between said upper and lower plate determines the transverse load applied by the friction damper assembly that must be overcome by the cantilever arm in order for said middle plate to move.

32. The apparatus of claim 30, further comprising flexible stop members fixedly mounted to the foundation opposite said friction damper assembly to limit the distance of travel of the free end of said arm.

33. The apparatus of claim 30 further comprising a flexible shear spring pad fixed beneath each said friction damper assembly and above the foundation, whereby shear forces are permitted to be transferred through said arm with a predetermined stiffness to assure that said damper assembly and said movable plates being relative displacement at approximately the same time.

34. The apparatus of claim 13 further comprising a first diaphragm, a second diaphragm, and a third diaphragm, said diaphragms rigidly connecting said columns and transferring forces between said columns, wherein said first diaphragm comprises interconnecting fixed length struts horizontally linking each said top plate to each adjacent top plate;

said second diaphragm comprises interconnecting fixed length struts horizontally linking said middle plates disposed beneath each said column to each adjacent middle plate of adjacent columns; and said third diaphragm comprises a floor supporting said bottom plates.

35. The apparatus of claim 13, wherein the fluid volume of said chambers of said centering pistons is maintained by a supply of fluid stored in an accumulator tank kept at high pressure, wherein each said chamber further comprises fluid lines extending from each end of said chamber to said accumulator tank, each said fluid line further comprising a control valve to pass the fluid pressure from the high pressure of the accumulator tank to the relatively lower pressure of said chamber, whenever the chamber pressure falls below a predetermined minimum pressure.

36. The apparatus of claim 13, wherein said biasing means of said centering pistons comprises:

a left flow circuit for circulating fluid from the zero position of the chamber to the left end of the chamber, said left flow circuit further comprising a check valve which opens only in a first flow condition in which the piston is in the left chamber and is moving towards the right chamber;

a right flow circuit for circulating fluid from the zero position of the piston head to the right end of the chamber, said right flow circuit further comprising a check valve which opens only in a second flow condition in which the piston is in the right chamber and is moving towards the left chamber;

said zero position of said piston head closing said left flow circuit and said right flow circuit, such that during a third flow condition in which said piston head is in the left chamber moving towards the left end of said chamber, no liquid flows through the left flow circuit and the right flow circuit, and during a fourth flow condition in which said piston head is in the right chamber moving towards the right end of said chamber, no liquid flows through the left flow circuit and the right flow circuit, and further such that the movement of the piston head through the chamber during said third and fourth flow conditions is solely regulated by said first set of control valves.

37. The apparatus of claim 36, wherein each of said chambers are mounted to the foundation atop shear spring cradles which are preferably constructed of neoprene, having a predetermined stiffness chosen to assure that said dampers and movable plates being relative displacement simultaneously.

38. The apparatus of claim 1, wherein said predetermined pressure for opening said first set of control valves can be chosen such that a series of individual control valves open in series, based on an incremental value of differential pressure.

39. The apparatus of claim 13, wherein said predetermined pressure for opening said first set of control valves can be chosen such that a single control valve opens and closes to automatically throttle the pressure to a substantially constant value as the relative velocity of the fluid changes.

* * * * *